United States Patent [19]

Clar

[11] 3,937,354

[45] Feb. 10, 1976

[54] APPARATUS FOR THE COMPACTION OF REFUSE MATERIAL AND THE LIKE

[76] Inventor: Milton Clar, 9408 Linden Ave., Bethesda, Md. 20014

[22] Filed: Jan. 14, 1974

[21] Appl. No.: 433,042

Related U.S. Application Data

[62] Division of Ser. No. 261,325, June 9, 1972, Pat. No. 3,861,296.

[52] U.S. Cl. ..... 220/63 R; 100/229 A; 141/316; 141/370; 141/390; 220/1 T; 220/65

[51] Int. Cl.[2] ..... B65D 25/14; B30B 15/06

[58] Field of Search ..... 220/1 T, 4 R, 4 E, 8, 63 R, 220/65, 73, 75, 76, 79, 80; 294/20, 33, 99 SAL; 217/3 R, 3 CB, 92; 141/312, 316, 369, 370, 372, 390; 248/95, 99, 101; 215/287, 288, 317; 150/10; 229/14 R, 14 B, 14 BE, 4.5, 93

[56] References Cited

UNITED STATES PATENTS

| | | | |
|---|---|---|---|
| 261,679 | 7/1882 | Cody | 229/89 |
| 342,818 | 6/1886 | Biedinger | 229/89 |
| 411,371 | 9/1889 | Biedinger | 229/89 |
| 652,331 | 6/1900 | Rudolph | 220/63 R |
| 1,088,633 | 2/1914 | Simmons et al. | 248/95 |
| 2,541,265 | 2/1951 | McGregor | 220/8 |
| 3,667,381 | 6/1972 | Bottas et al. | 100/229 A |
| 3,714,890 | 2/1973 | Moon | 100/229 A |
| 3,722,561 | 3/1973 | O'Leary et al. | 220/63 R |
| 3,734,340 | 5/1973 | Ippolito et al. | 220/65 |
| 3,762,599 | 10/1973 | Bourgeois | 220/63 R |
| 3,765,143 | 10/1973 | Ippolito et al. | 53/124 B |
| 3,779,156 | 12/1973 | Race | 220/63 R |
| 3,807,299 | 4/1974 | Engebretsen | 220/63 R |

*Primary Examiner*—William Price
*Assistant Examiner*—Stephen Marcus
*Attorney, Agent, or Firm*—Shapiro and Shapiro

[57] ABSTRACT

Compaction apparatus in which a material receiver chamber and a container are supported upon a carriage which tilts out of a cabinet to permit material to be inserted into the receiver chamber and which returns to a rest position within the cabinet for the compaction operation. Hydraulic rams pull a cylindrical compaction blade downwardly through the access opening of the receiver chamber, and the initial movement of the blade locks the carriage in its rest position. A carriage door permits the removal of the loaded container, and a latch holds the carriage in its rest position when the container is removed. A system of electrical interlocks ensures safe operation.

5 Claims, 18 Drawing Figures

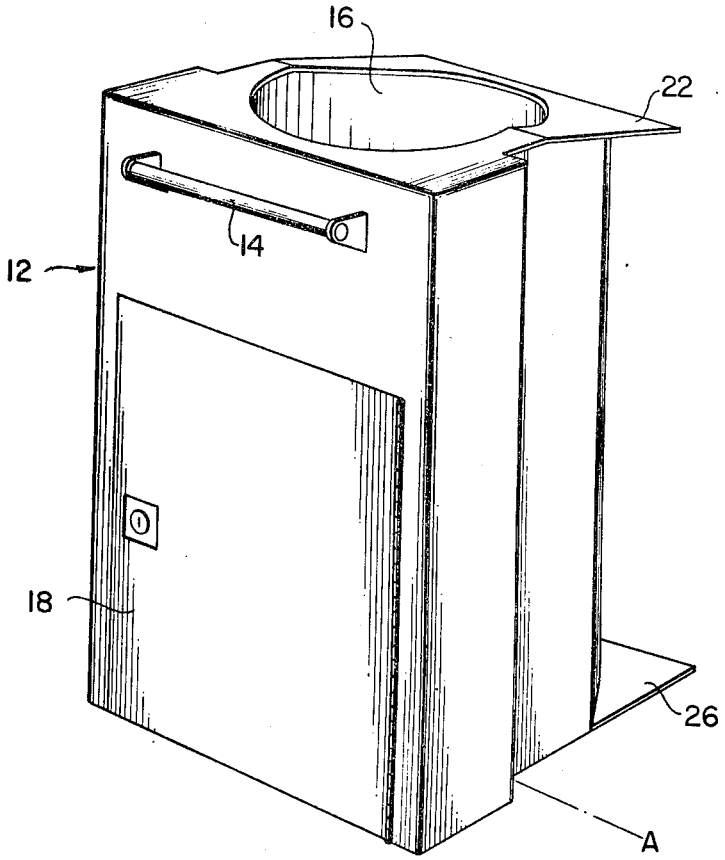
FIG. 5
FIG. 6
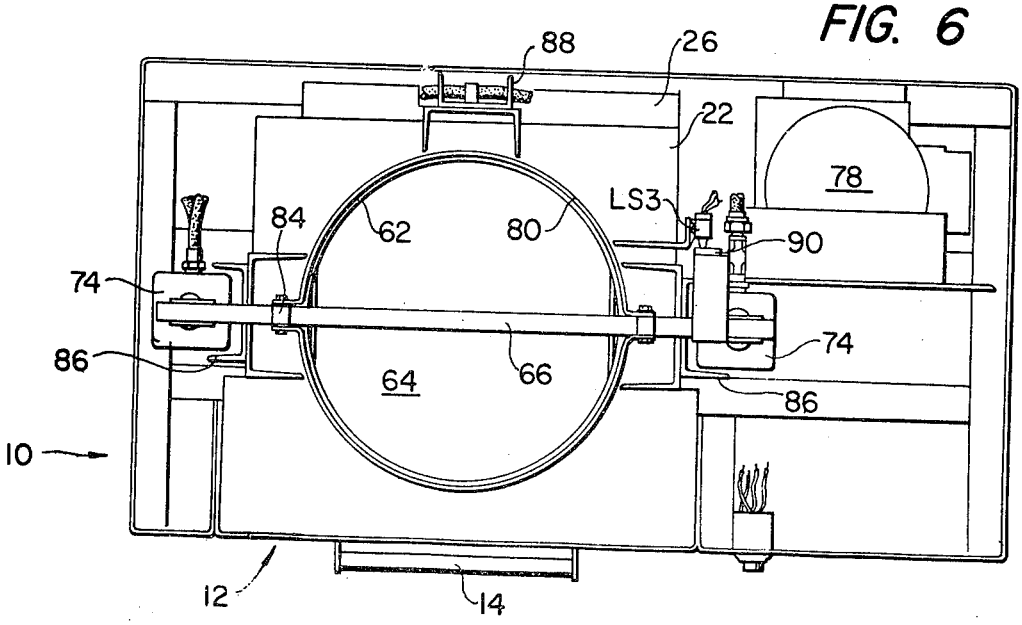

APPARATUS FOR THE COMPACTION OF REFUSE MATERIAL AND THE LIKE

This is a divisional application of Ser. No. 261,325, filed June 9, 1972, now U.S. Pat. No. 3,861,296.

BACKGROUND OF THE INVENTION

This invention relates to compaction apparatus for refuse material and the like and is more particularly concerned with simple and inexpensive hand-fed apparatus for compacting material into bags or other small receptacles.

In recent years the market for refuse compaction apparatus has expanded greatly. Various types of units have become widely available, including large stationary packers which compact refuse into roll-off bodies of trucks, smaller stationary packers which compact material into detachable containers that are dumped into truck bodies by self-loading mechanisms, and stationary packers which are used in conjunction with small receptacles such as bags or barrels. Despite the diversity of available equipment, a need has existed for a small and inexpensive hand-fed compaction apparatus for use in garden-type apartments and other establishments of limited size. Heretofore, such establishments have used smaller versions of complex and expensive compaction apparatus or have had to be satisfied with rather crude and inefficient compaction apparatus.

BRIEF DESCRIPTION OF THE INVENTION

It is a principal object of the present invention to provide improved compaction apparatus, which, while substantially less expensive than larger units, is none-the-less highly efficient.

A further object of the invention is to provide a simple, handfed compaction apparatus which may be employed safely by housewives or children and which compacts refuse and the like into conventional receptacles with high compaction ratios.

Yet another object of the invention is to provide apparatus of the foregoing type which is not only simple to operate but which is easily and safely maintained by custodial personnel.

Briefly stated, a preferred embodiment of the present invention is a so-called vertical packer. The compaction blade is housed within a cabinet and is pulled downwardly by a pair of hydraulic rams for compacting material through a material receiver chamber into a container. The material receiver chamber and the container are supported upon a carriage which is pivotally mounted upon the cabinet for tilting movement about a horizontal axis between a rest position at which the carriage is contained within the cabinet and an access position at which the upper end of the carriage tilts outwardly of the cabinet to expose the access opening of the material receiver chamber. When the carriage is in its rest position, the access opening is inacessible, and once the compaction apparatus has been actuated, the carriage is locked in its rest position. When the container is full, an alarm is given, and the container is removed from the carriage by means of a door in the carriage which may be opened by a custodian. Removal of the container locks the carriage in its rest position. The container is a split cylinder, which may receive a bag therein, which in turn may receive a liner therein to protect the bag during compaction. An electrical system ensures proper and safe operation.

BRIEF DESCRIPTION OF THE DRAWINGS

The invention will be further described in conjunction with the accompanying drawings, which illustrate a preferred and exemplary embodiment, and wherein:

FIG. 5 is a perspective view of the tilting carriage;

FIG. 6 is a top plan view of the invention, with the top cover removed to expose the internal parts;

DETAILED DESCRIPTION OF THE INVENTION

Figure 1:
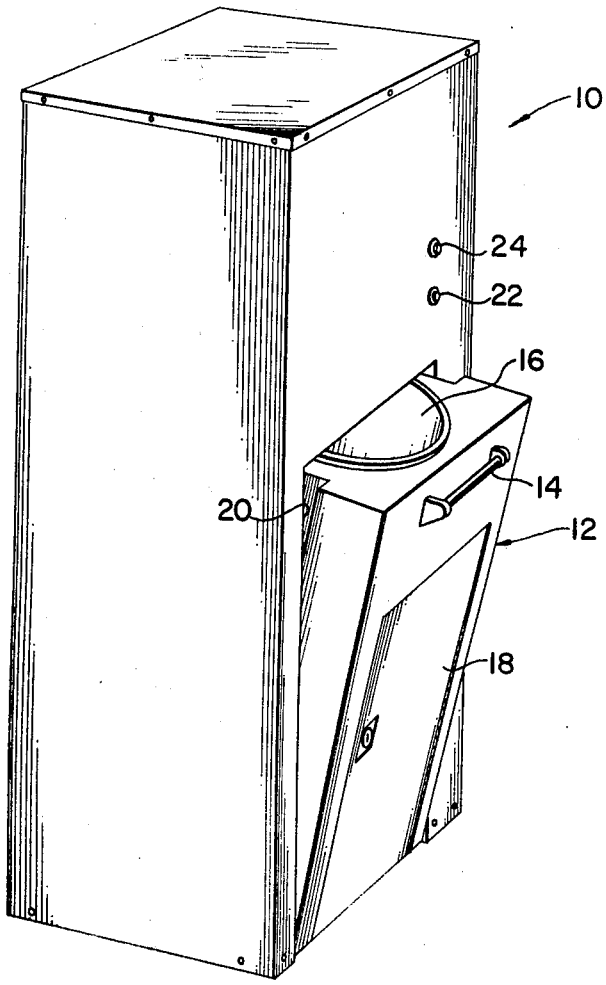
FIG. 1 is a perspective view of compaction apparatus in accordance with the invention.

Referring to the drawings, and initially to FIG. 1 thereof, the compaction apparatus of the invention comprises a cabinet 10, which may be of generally rectangular configuration, having a carriage 12 pivotally supported thereon near the bottom of the carriage and the cabinet. In its rest position the carriage is housed within the cabinet, but the upper end may be tilted outwardly (even beyond the position shown in FIG. 1) by pulling upon a handle 14 to expose the access opening 16 of a material receiver chamber. The carriage is provided with a locked door 18 so that access to the container may be obtained by a custodian. As shown in FIG. 1, the front wall of the cabinet has a rectangular opening 20 through which the carriage tilts. An actuator button 22 and a signal lamp 24 are also provided upon the front wall; their functions will be described more fully hereinafter.

As shown in FIG. 5, the carriage is a hollow shell having the opening 16 in the top wall thereof, the top wall slanting downwardly at the rear portion 22' thereof to permit the upper end of the carriage to be tipped forwardly from the cabinet about the axis indicated at A in FIG. 5 without interference between the top wall of the carriage and the top edge of the opening 20 (FIG. 1) through which the carriage tilts. The pivotal movement is provided by means of hinges 24' (FIGS. 3 and 4) supporting the bottom wall 26 of the carriage upon the bottom frame structure of the cabinet sufficiently above the floor to permit the carriage to tilt. Stops 28 (FIGS. 3 and 4) limit the outward tilting movement of the carriage. Inward tilting movement is limited by engagement of the bottom of the carriage with the bottom frame of the cabinet. The carriage has front and side walls in addition to the top and bottom walls but may be open at the back.

Figure 4:
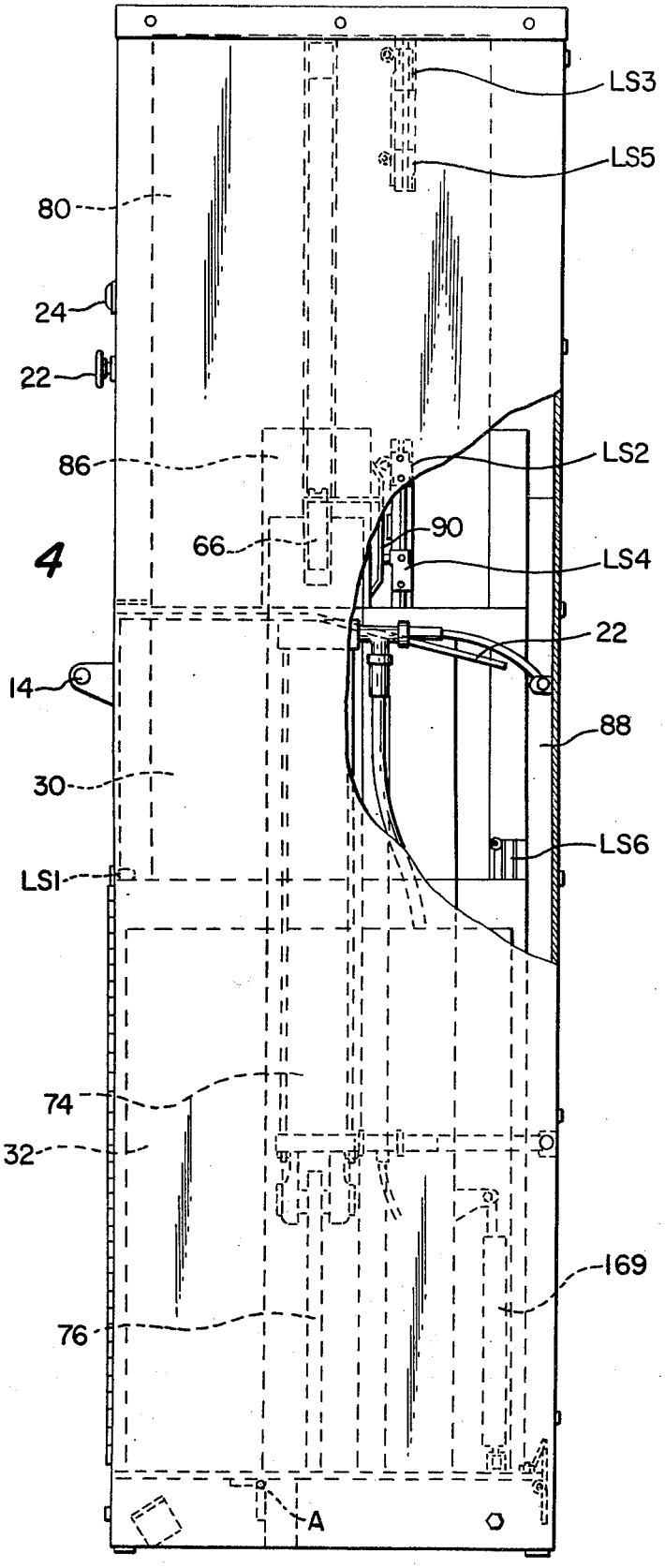
FIG. 4 is a side elevation view of the invention, partially broken away.
Figure 14:
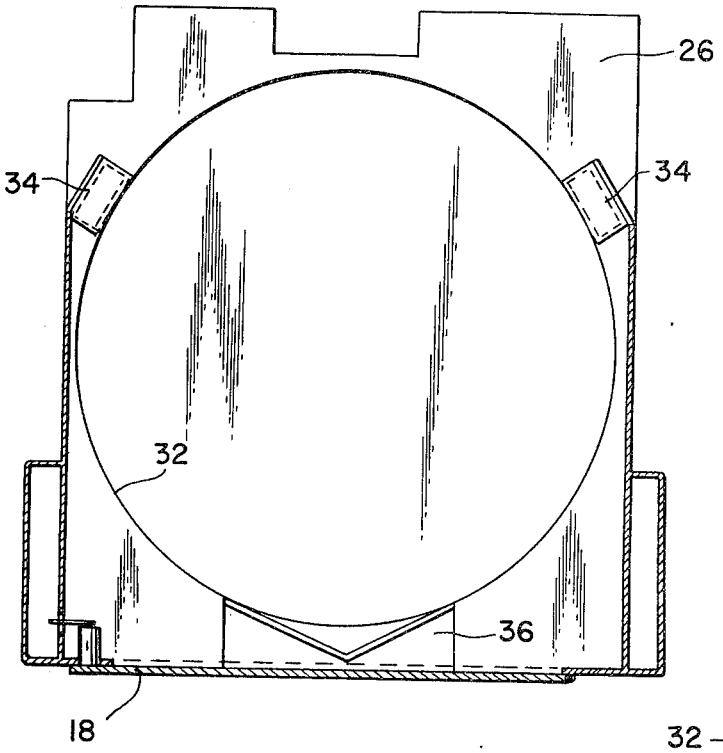
FIG. 14 is a horizontal sectional view illustrating the manner in which the container is positioned upon the carriage.

As shown in FIG. 4, a cylindrical blade guide 30 depends from the opening 16. This guide constitutes the material receiver chamber or charging box. Beneath the blade guide a cylindrical container 32 is supported upon the bottom wall 26 of the carriage. As shown in FIG. 14, the container is positioned against a pair of carriage standards 34, the upper portions of which assist in supporting the blade guide 30. A plate 36 mounted on the back of the door 18 forces the container against the standards 34 when the door is closed.

Figure 9:
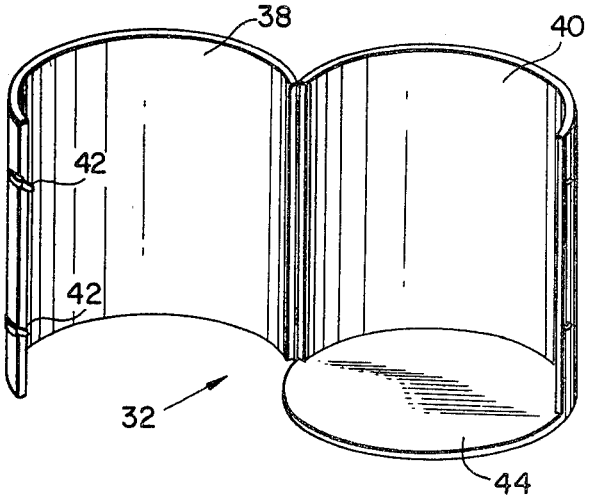
FIG. 9 is a perspective view of a container employed in the invention, shown open.
Figure 10:
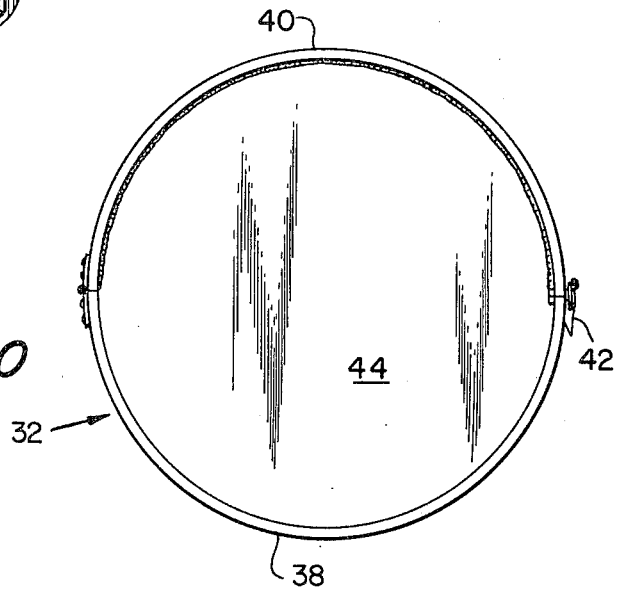
FIG. 10 is a top plan view of the container, shown closed.
Figure 11:
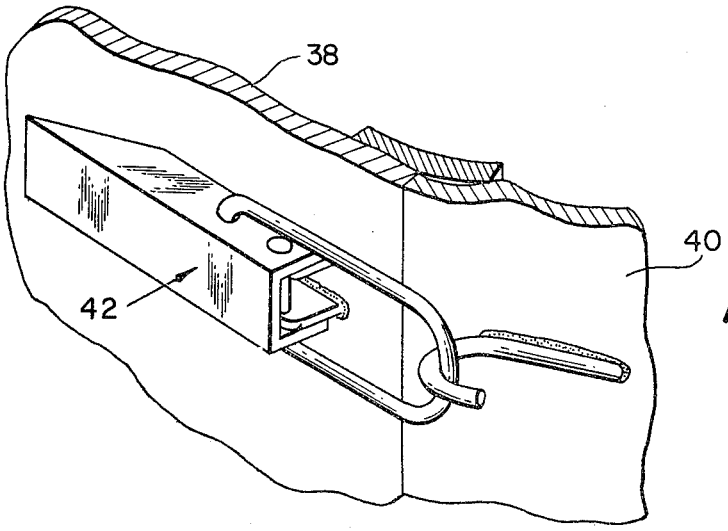
FIG. 11 is a fragmentary perspective view of a container latch.

FIGS. 9–11 illustrate the container in greater detail. As shown, the container may be a split cylinder having a pair of hemicylinder walls 38 and 40 pivotally connected along a longitudinal edge thereof. Adjacent to the opposite edge latches 42 are provided. The latches may be a conventional over-center type as shown in FIG. 11. A circular bottom wall 44 may be affixed to one of the walls 38 and 40, such as wall 40. During compaction the container is closed by the latches 42. It is opened to remove the compacted material.

Figure 12:
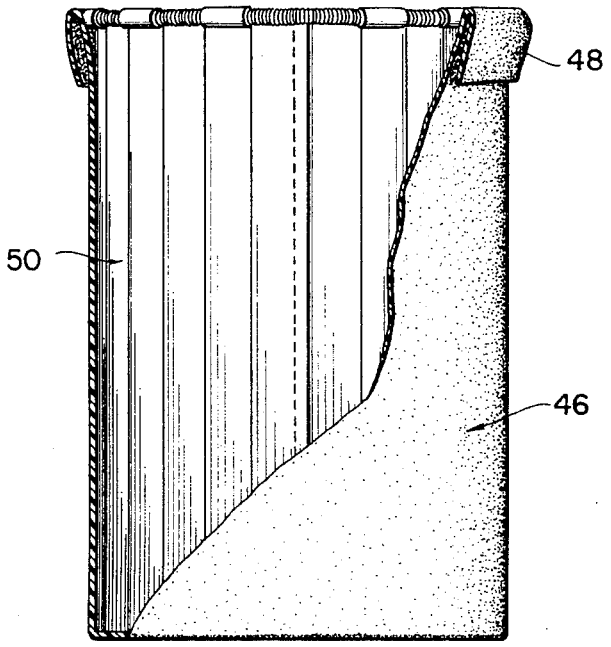
FIG. 12 is a side elevation view, partially broken away, showing a bag and bag-liner which may be employed in the container.
Figure 13:
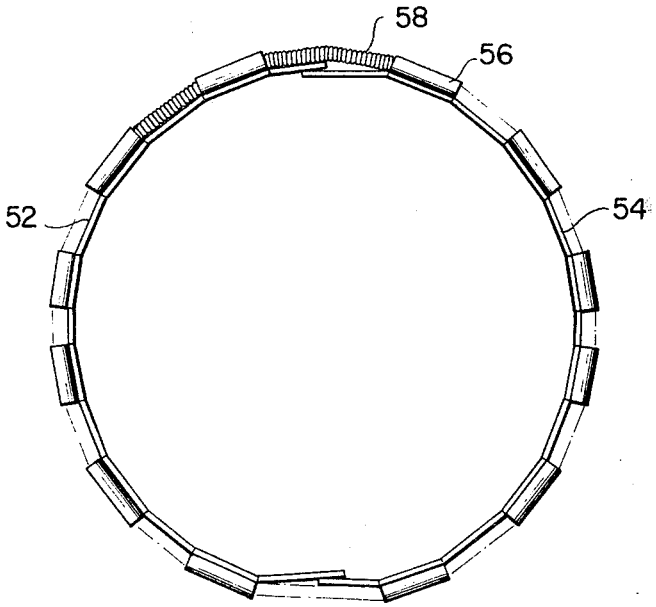
FIG. 13 is a top plan of the bag liner.

FIGS. 12 and 13 illustrate a bag and liner assembly which may be inserted within the container. The bag 46 may be a conventional paper or plastic bag, the open end of which may be folded back to form a cuff 48 over the top of the container 32. To prevent cutting of the bag by sharp fragments during compaction, a sheet metal liner 50 may be inserted in the bag. The liner may comprise a pair of overlapped cylinder parts 52 and 54, which may be constituted by a series of straight segments. Portions of the upper edges of the cylinder parts are rolled over to provide sleeves 56 which receive a coil spring 58, the ends of which are joined to form a continuous spring which holds the upper ends of the cylinder parts 52 and 54 together. The lower ends of the cylinder parts are free, so that the liner may be easily lifted from the refuse-filled bag with minimal resistance.

Figure 7:
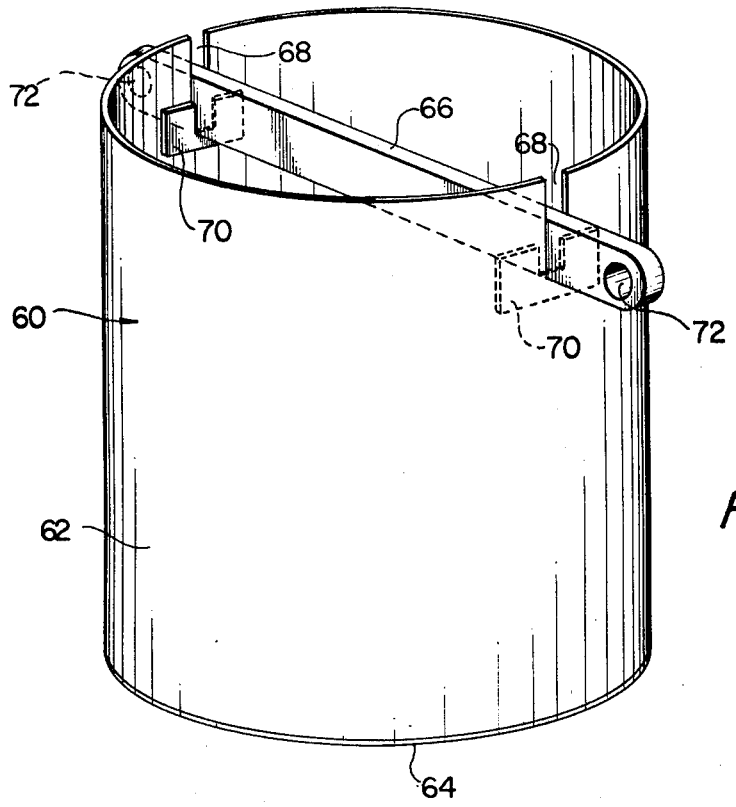
FIG. 7 is a perspective view of the compaction blade.
Figure 8:
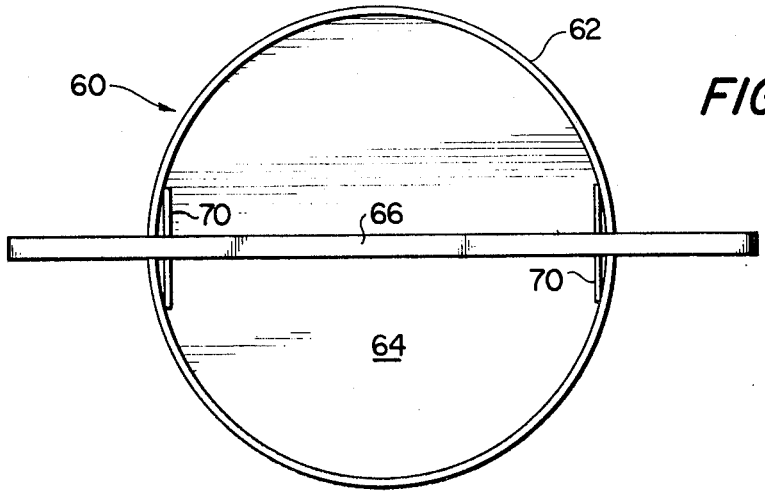
FIG. 8 is a top plan view of the compaction blade.

The compaction blade structure is illustrated in FIGS. 7 and 8. The blade 60 may comprises a cylindrical side wall 62 closed at the bottom by a wall 64, which constitutes the blade or platen surface that actually contacts the compacted material. The top of the blade may be open. A bar 66 extends across the top of the blade, being supported in slots 68 in the side wall. Notched plates 70 engage the bar from within the blade to stiffen the blade-bar structure, which may be welded together. Bores 72 in the ends of the bar receive pins for coupling piston rods of hydraulic rams to the blade structure.

Figure 3:
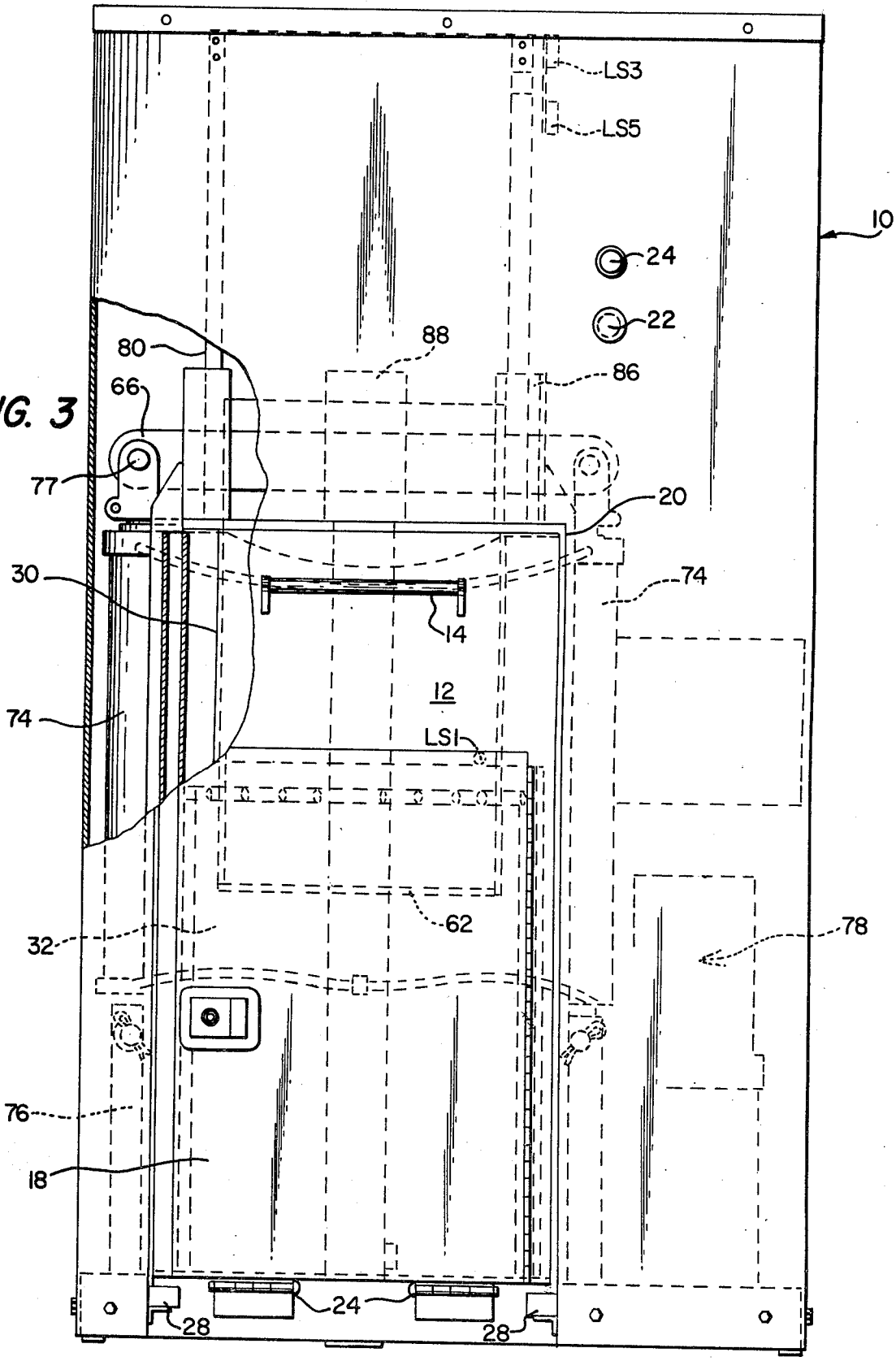
FIG. 3 is a front elevation view of the invention, partially broken away.

As shown in FIG. 3, hydraulic rams 74 are located at opposite sides of the carriage. The lower ends of the cylinders of the rams are connected to the cabinet frame by means of brackets 76, the piston rods being connected to the blade by pins 77. The hydraulic rams are driven from a power pack designated generally by reference numeral 78 in FIG. 3.

Figure 2:
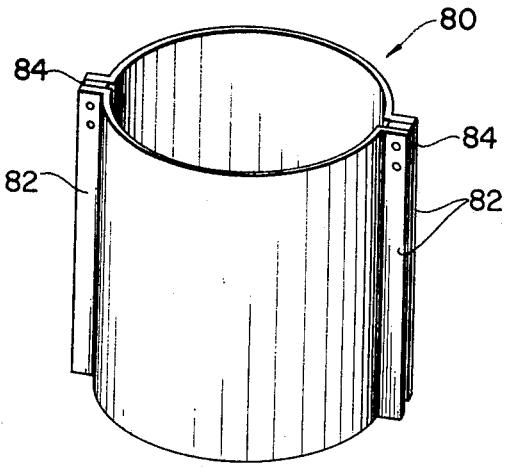
FIG. 2 is a perspective view of an upper blade guide employed in the invention.

Movement of the blade in the upper part of the cabinet is guided by a split cylinder 80 shown in FIG. 2. The cylinder parts are provided with flanges 82 joined at the upper end thereof by blocks 84. As shown in FIGS. 4 and 6, the cylindrical guide 80 is supported within the housing by means of vertical channel members 86 and 88 of the cabinet frame, which engage the lower portion of the guide. Rod 66 of the blade structure passes through slots defined by the spaced flanges 82 of the blade guide. The upper ends of channels 86 and the associated mounting brackets for the cylindrical blade guide are also slotted as shown in FIG. 4 for passage of the bar 66. FIG. 3 shows the blade at its lowermost position fully extended through the blade guide 30 and into the container 32. In its uppermost or fully retracted position, the lower end of the blade is just above the top of the carriage, permitting the carriage to be tilted from the cabinet. Once the blade commences its downward movement and enters the blade guide 30, the carriage is thereby locked within the cabinet. In this position, the carriage fits closely within cabinet opening 20, so as to prevent access to the cabinet by the user.

As shown in FIG. 4, one end of the bar 66 is provided with a shoe or cam 90 for actuating a group of switches LS3, LS5, LS2 and LS4 supported in the cabinet along the path of the cam 90. The operation of these switches and other switches, LS1 and LS6, will become apparent hereinafter in connection with the description of FIGS. 17 and 18.

Figure 18:
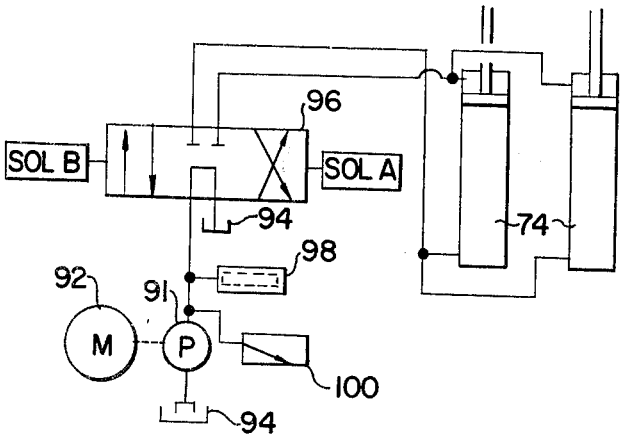
FIG. 18 is a circuit diagram of the hydraulic system employed in the invention.

As shown in FIG. 18, the power pack for driving the hydraulic rams 74 may comprise a conventional pump 91 driven by an electric motor 92. The pump supplies hydraulic fluid to the rams 74 from a reservoir 94 by means of a three-position solenoid-actuated valve 96. In the center or neutral position of the valve the hydraulic fluid is returned to the reservoir as shown in FIG. 18. When the valve is moved to the left by solenoid A, hydraulic fluid is supplied to the tops of the cylinders of ram 74, driving the pistons downwardly for the power stroke of the blade. When the valve 96 is shifted to the right by solenoid B, the rams move the blade in the opposite direction for its retraction stroke. A pressure switch 98 senses the hydraulic pressure supplied to the rams for a purpose to be described. An overload valve is shown at 100.

Figure 17:
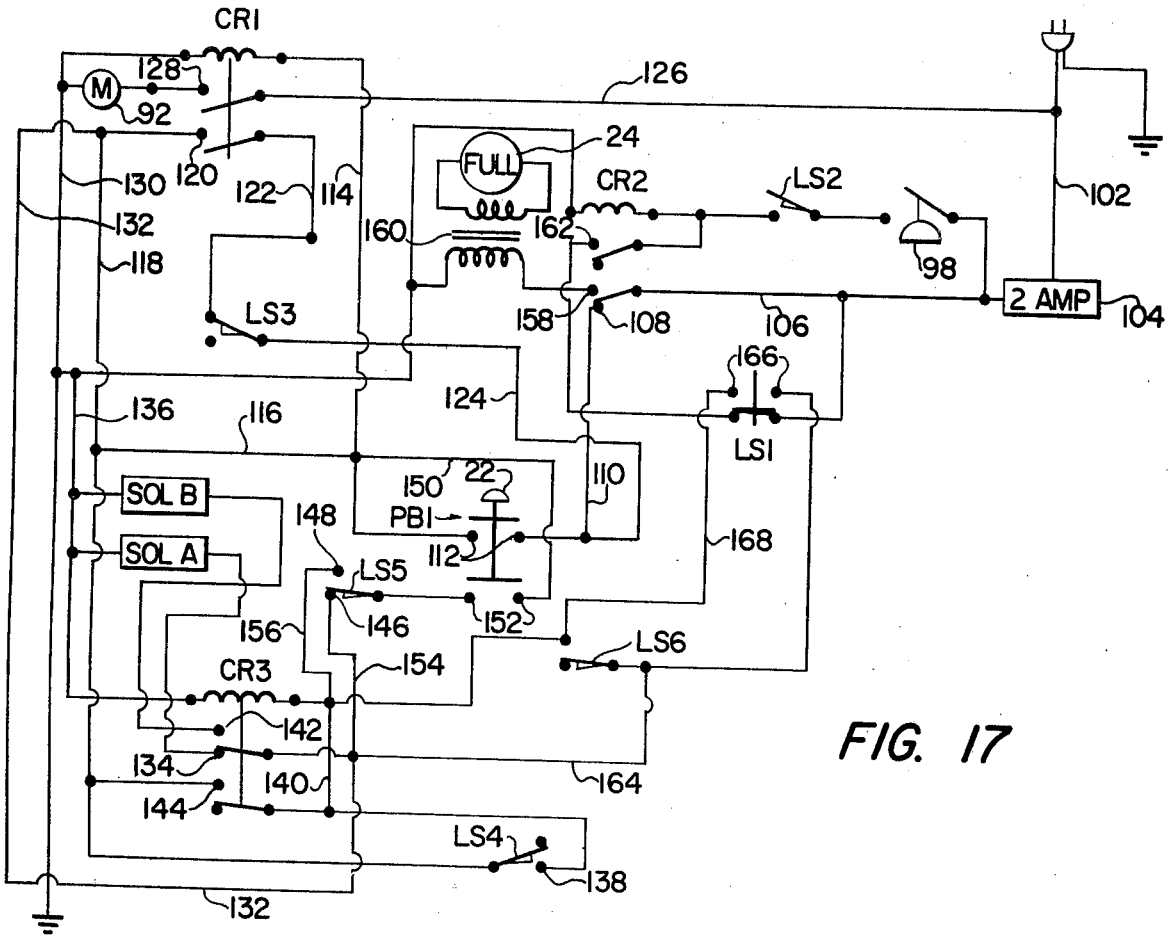
FIG. 17 is a circuit diagram of the electrical system employed in the invention.

FIG. 17 illustrates an electrical system for controlling the operation of the hydraulic system of FIG. 18. The pump motor 92 is energized from the 115 volt AC supply when relay CR1 is energized. The energization of relay CR1 is initiated by momentary closure of switch PB1 actuated by the actuator button 22 (see FIG. 1), a circuit being completed from the hot side of the AC supply through conductor 102, fuse 104, conductor 106, contact 108 of relay CR2, conductor 110, contacts 112 of switch PB1, conductor 114, and the coil of relay CR1 to the grounded side of the AC supply. A holding circuit for relay CR1 is completed by the relay itself through conductor 114, conductor 116, conductor 118, contact 120 of the relay, conductor 122, switch LS3, and conductor 124 back to conductor 110. Energization of relay CR1 completes a circuit for the pump motor 92 from the hot side of the AC supply through conductor 126 and contact 128 of the relay, one side of the motor 92 being connected to the grounded side of the supply by conductor 130.

Momentary closure of switch PB1 also completes a circuit for energizing solenoid A, through conductor 110, contacts 112, conductor 150, contacts 152, switch LS5, conductor 154, contact 134 of a relay CR3, and through solenoid A and conductor 136 to the ground conductor 130. Energization of relay CR1 completes a holding circuit for solenoid A, which may be traced through conductor 110, conductor 124, switch LS3, conductor 122, contact 120 of relay CR1, conductor 132, and contact 134 of relay CR3.

When solenoid A is energized, the control valve 96 (FIG. 18) is shifted to cause the commencement of the downward movement of the blade from its normal rest position near the top of the cabinet. Switch LS3 is held open by the cam 90 associated with the blade when the blade is in its fully retracted position. As the blade moves downwardly, switch LS3 closes to the position illustrated in FIG. 17, permitting the application of power to contact 120 of relay CR1 and permitting completion of the circuits through this contact, as referred to above. Any material in the receiver chamber and container is compacted.

When the blade reaches almost to its lowermost position, switch LS4 is transferred so as to close upon contact 138. AC power is then applied from conductor 118 through switch LS4 and conductor 140 to to relay CR3, energizing relay CR3, causing the relay to transfer its contacts. Power is then applied from conductor 132 through contact 142 to solenoid B, energizing this solenoid. Solenoid A is de-energized upon energization of relay CR3, because power is no longer supplied to contact 134 of the relay. When relay CR3 is energized, a holding circuit for the relay is completed by means of conductor 140, contact 144 and conductor 118 back to contact 120 of relay CR1.

Energization of solenoid B shifts the control valve 96 so as to retract the blade. Switch LS4 opens, but the blade continues to retract until it reaches almost to its uppermost position, at which time switch LS3 is opened, breaking the holding circuit for relays CR1 and CR3 through contact 120. The system is thus de-energized.

Switch LS5 is a safety override switch. Once the blade has moved down a few inches, switch LS5 transfers from contact 146 to contact 148. Now, instead of energizing solenoid A through contact 146, conductor 154, and contact 134, actuation of switch PB1 closes a circuit from conductor 110, through contacts 112, conductor 150, contacts 152, contact 148 of switch LS5, and conductor 156 to the coil of relay CR3, energizing the relay and solenoid B, and causing the blade to retract, as long as switch PB1 is held actuated. Thus, the same actuation switch may be employed for causing the blade to move downwardly and for later causing the blade to retract. When the blade returns to its upward position, switch LS5 transfers again to engage contact 146 to prepare the blade for downward movement.

As the blade approaches its lowermost position, a zone switch LS2 is closed. This will have no effect unless pressure switch 98 is closed, indicating by the hydraulic pressure (and thus the load on the blade) that the container is full. If the pressure switch is closed and switch LS2 is closed, relay CR2 will be energized, breaking the circuit to contact 108 and removing power from conductor 110 and the components supplied therefrom. Power will be applied to contact 158, energizing transformer 160 and "full" indicator lamp 24 (see FIG. 1). A holding circuit for relay CR2 is completed through contact 162 and switch LS1, which is held in the position shown when door 18 of the carriage is closed. Under these conditions the compaction blade will remain extended into the container, and the user will be unable to operate the blade.

When a custodian notices the "full" indication and opens the door 18, switch LS1 will transfer its contacts, de-energizing relay CR2 and lamp 24 and returning power to conductor 110. If switch PB1 is then actuated, relay CR1 and relay CR3 will be energized (LS5 will be closed on contact 148) and the blade will retract. When the blade retracts enough to close switch LS5 on contact 146, the circuit to relay CR3 through contact 148 will be broken, but a new circuit will be completed through contact 146, conductor 154, conductor 164, contacts 166 of switch LS1, and conductor 168, to continue the retraction of the blade until the opening of switch LS3 de-energizes the pump. When an empty container is placed within the carriage and the door 18 is closed, the apparatus is ready for use again.

If an attempt is made to operate the apparatus with the carriage away from its rest position, switch LS6 will close (being held open by the carriage in its rest position), completing a circuit to relay CR3 if the safety override switch is closed upon contact 146, and returning the blade to its fully retracted position. This may occur if the carriage is left open for a long period and if the compaction blade drifts downwardly because of seepage of hydraulic fluid.

The weight of the carriage with a container thereon is preferably counterbalanced with respect to the pivotal axis A, so that a strong effort is not required to tilt the carriage outwardly. The carriage must be pulled to expose the access opening 16, and if pulled out fully will move slightly over-center. It will return to the rest position when pushed over-center in the opposite direction. Suitable dampers 169 (FIG. 4) may be employed to buffer the return of the carriage within the cabinet.

Figure 15:
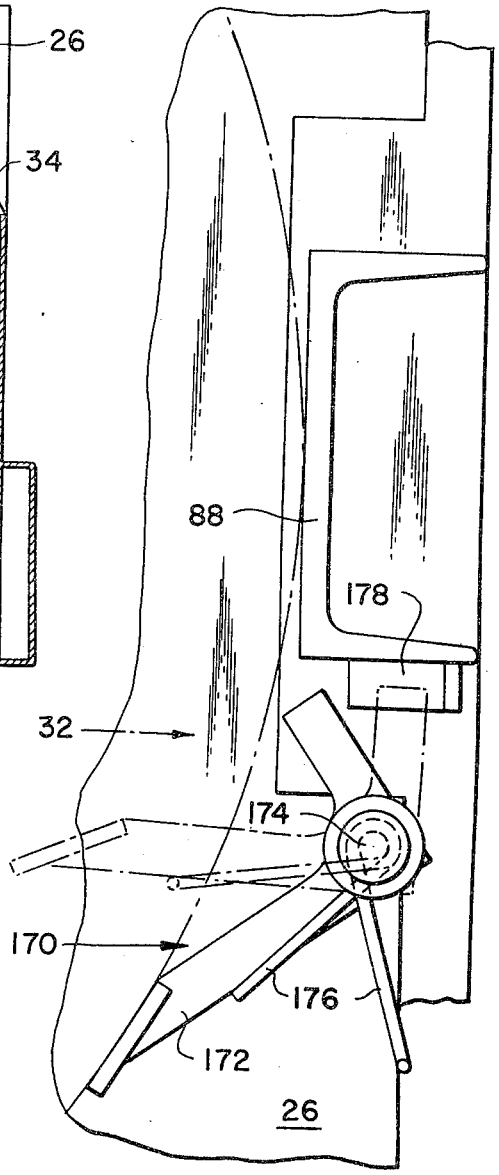
FIG. 15 is a fragmentary top plan view of a carriage latch.
Figure 16:
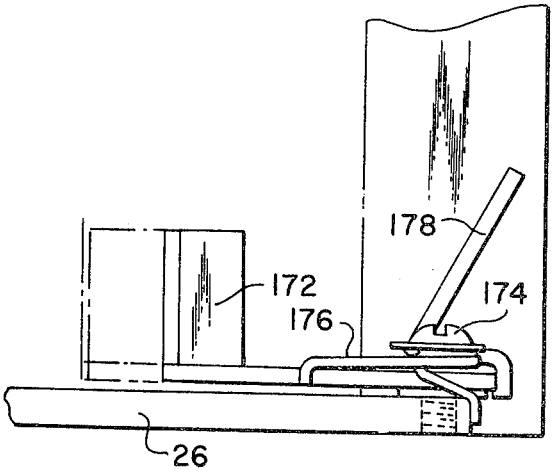
FIG. 16 is a fragmentary side elevation view of the carriage latch.

When the door 18 is opened and the container is removed, the balance of the carriage will change, tending to tip the carriage outwardly. An automatic latch 170 may be employed as shown in FIGS. 15 and 16 to prevent this. The latch may comprise a lever 172 pivotally mounted on the bottom 26 of the carriage at 174 and pressed rearwardly by the container 32 against the bias of a spring 176. When the container is moved away from channel 88, the lever 172 is turned by spring 176 until it engages keeper 178 mounted on channel 88, latching the carriage in its rest position. When the container is replaced, the lever is moved to unlatch the carriage.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. Apparatus for lining a bag comprising a cylindrically tubular member having a top and a bottom, said member being split longitudinally from top to bottom into separate overlapping parts, said parts being connected at said top only, by flexible connecting means.

2. Apparatus in accordance with claim 1, wherein said parts have sleeves at said top through which said flexible connecting means extends.

3. Apparatus in accordance with claim 2, wherein said sleeves are constituted by rolled end portions of said parts.

4. Apparatus in accordance with claim 2, wherein said flexible connecting means comprises a spring.

5. Apparatus in accordance with claim 4, wherein said parts are semi-cylindrical, wherein said sleeves are constituted by rolled end portions of said parts extending circumferentially of said parts and wherein said spring is an elongated coil spring extending circumferentially around said parts.

* * * * *